United States Patent [19]

Hyman et al.

[11] 4,195,680

[45] Apr. 1, 1980

[54] COLOR VARIABLE WINDOW COVERING

[75] Inventors: David L. Hyman; Robert J. Cayton; Kurt E. Rosenquist, all of Pacific Palisades, Calif.

[73] Assignee: Louverdrape, Inc., Santa Monica, Calif.

[21] Appl. No.: 931,547

[22] Filed: Aug. 7, 1978

Related U.S. Application Data

[63] Continuation of Ser. No. 733,316, Oct. 18, 1976, abandoned, which is a continuation-in-part of Ser. No. 679,764, Apr. 23, 1976, Pat. No. 4,049,038.

[51] Int. Cl.[2] ..... E16B 9/26

[52] U.S. Cl. ..... 160/166 A; 160/236

[58] Field of Search ..... 160/166–173, 160/236; 40/64, 65; 273/157 A; 35/28.3, 23.6, 53

[56] References Cited

U.S. PATENT DOCUMENTS

| | | | |
|---|---|---|---|
| 518,806 | 4/1894 | Dillmann | 273/157 A |
| 799,609 | 9/1905 | Ludwig | 273/157 A |
| 1,949,653 | 3/1934 | Moore | 160/236 |
| 2,074,482 | 3/1937 | Martens | 160/236 |
| 2,142,629 | 1/1939 | Clark, Jr. | 160/173 |
| 3,267,589 | 8/1966 | Stanish | 35/28.5 |
| 3,481,388 | 12/1969 | Smart | 160/236 |
| 3,645,317 | 2/1972 | Malone | 160/236 |
| 3,649,024 | 3/1972 | Katzman | 273/157 A |
| 4,049,038 | 9/1977 | Hyman et al. | 160/166 A |

*Primary Examiner*—Peter M. Caun
*Attorney, Agent, or Firm*—Lyon & Lyon

[57] ABSTRACT

Disclosed herein is a system for decorative covering of windows and the like which includes a plurality of colorable louvers in association with a louvered support system. The louvers include means for readily attaching one or more colored transparent sheets thereon in a superimposed relationship to present a covering of a desired color. Provision is made for facile replacement of the colored sheets to allow the presentation of a differently colored cover without the need for louver replacement.

7 Claims, 4 Drawing Figures

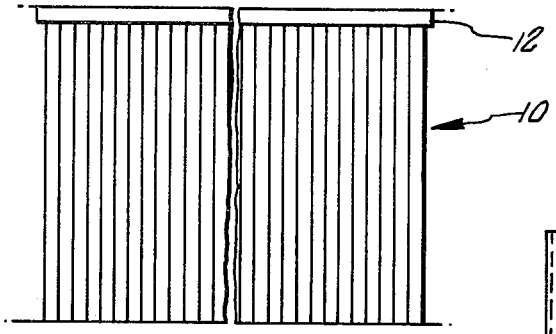
FIG. 1
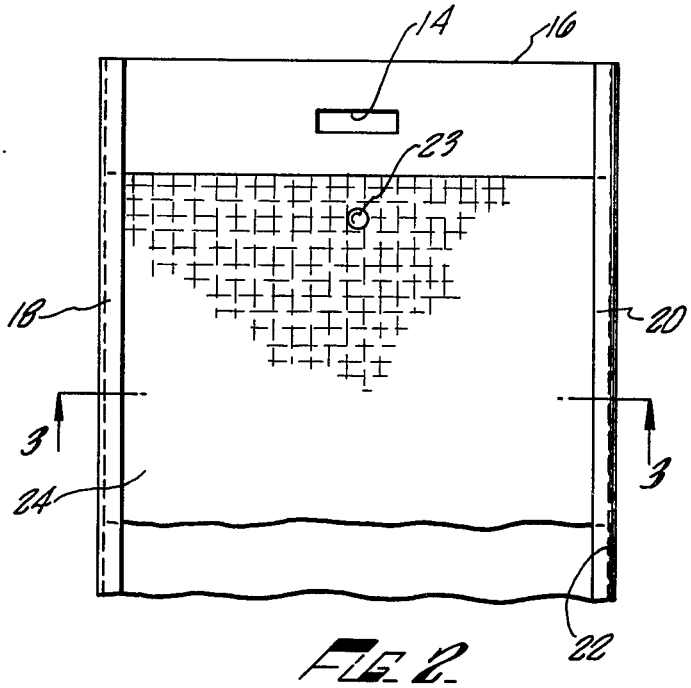
FIG. 2
FIG. 3
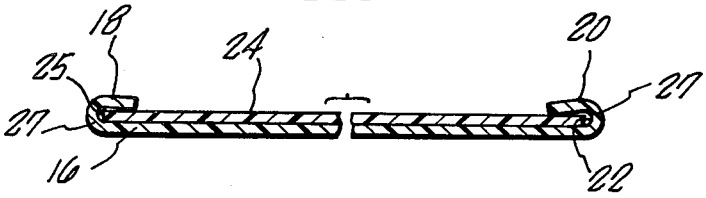
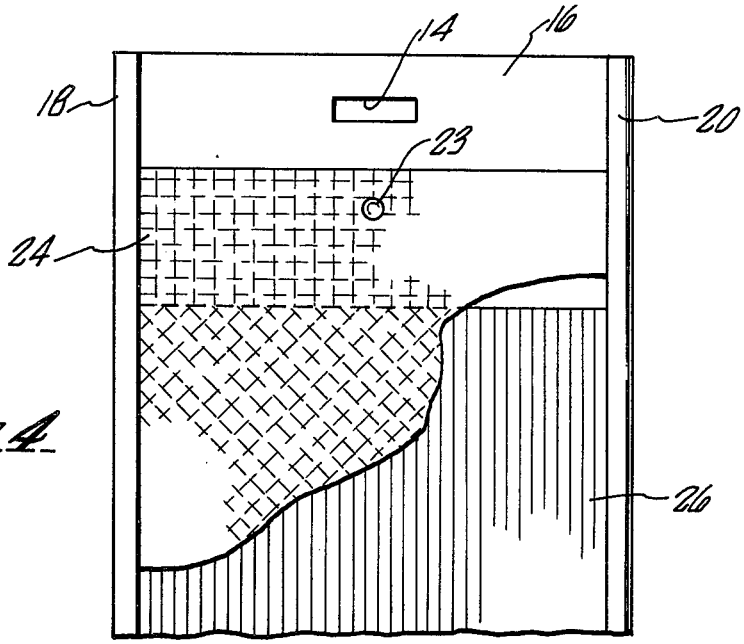
FIG. 4

COLOR VARIABLE WINDOW COVERING

This application is a continuation of parent application Ser. No. 733,316, now abandoned filed Oct. 18, 1976, which is in turn a continuation-in-part of parent application Ser. No. 679,764 for a LOUVERED COVERING SYSTEM, filed Apr. 23, 1976, which issued as U.S. Pat. No. 4,049,038 on Sept. 29, 1977.

BACKGROUND OF THE INVENTION

The present invention is related to a louvered covering system, and more particularly, to a louvered covering system which allows facile changes to the color appearance of the system.

Louvered window coverings have been used extensively for decorative coverings of windows, doors and the like. It has long been a practice to color coordinate the louvers in such systems with the building or room decor. However, because of the tremendous number of colors and different shades of colors used in contemporary styling, if a color covering other than paint is employed on the louvers a very large inventory of such coverings must be maintained in order to make available a suitable variety of colors. This limitation has retarded the use of color coordinated louver assemblies. In addition, when it becomes desirable to change the decorative requirements, i.e., the color of the louvered system, it is necessary either to replace the louvers themselves or paint the louvered system. As a result of the costs and time involved in making such changes, the coloring of such a system is infrequently altered.

It would be highly desirable to provide a window covering with the functional advantages of a louvered system which could be offered in a very wide range of colors without having to maintain a correspondingly large supply of colored louvered coverings. It would also be desirable to provide a window covering the color of which could be readily altered to facilitate redecorating.

SUMMARY OF THE INVENTION

Briefly, the present invention relates to a louvered covering system wherein the louvers can be colored with one or more of a wide variety of colors and hues without having to maintain a corresponding variety of colored louvered coverings. The louvered covering system also allows great flexibility in changing the color thereof and the decorative effect of the system. To accomplish this flexibility, louvers are provided with flanges running along each elongated edge thereof. The flanges extend inwardly to form a very wide, low locking channel capable of receiving one or more of such colored transparent sheets in a superimposed relationship, which sheets present the color of the louver. By varying the colors of the sheets and overlapping relationships, a great number of differently colored louver systems can be presented with a relatively small number of sheets. Using only two sheets in a superimposed relationship the possible color combinations vary as the square of the number of colored sheets available.

It is the principal object of the present invention to provide a louvered covering system which utilizes superimposed translucent sheets of different colors to selectively display a wide variety of colors with a minimum number of such sheets.

It is another object of the present invention to provide a louvered covering system, the color of which can be readily and economically varied.

Other objects and advantages of the present invention will become apparent from the following detailed description taken in conjunction with the accompanying drawings.

BRIEF DESCRIPTION OF THE DRAWINGS

FIG. 1 is a front elevation of a louvered covering system illustrating the use of vertical louvers.

FIG. 2 is a detailed plan view of a louver of the present invention partially broken away for clarity.

FIG. 3 is a cross-sectional end view taken along lines 3—3 of FIG. 2.

FIG. 4 is a plan view of the louver having two second translucent sheets held therein to present a different color.

DETAILED DESCRIPTION OF THE PREFERRED EMBODIMENT

Turning now in detail to the drawings, FIG. 1 illustrates a louvered covering system including vertical louvers 10 associated with a louver support system 12 of a conventional design. Conventional louver support systems commonly include a wide, flat, hooking member which cooperates with a slot to both hang the vertical louver 10 and effect some control over its orientation about a vertical axis. Such an attachment means may include a slot 14 such as that seen in FIG. 2.

Turning to the details of each louver, the louver is seen in the drawings to include an elongated panel 16 which is most conveniently of a plastic material. Along each elongate edge of the panel 16 is a flange 18 and 20. The flanges each extend inwardly on the same side of the panel to form a narrow low locking channel 22. This channel is capable of receiving a colored transparent sheet 24 therein or, alternatively, a plurality of differently colored transparent sheets in a superimposed relationship to define the color of the louver. The sheet or sheets are held in place within the locking channel 22 by means of a rivet 23 or other suitable fastening member which extends through both the sheets and the panel. Alternatively, these sheets can be held within the locking channel by the pressure of the ends 27 thereof pressing against the longitudinal edges 25 of the sheets. The former method, however, has found to be more suitable when disposing the louvers in a vertical position due to the increased holding ability of the rivet, particularly when only a single sheet is being held by the panel.

By way of example, the sheet 24 is yellow in color and when held within the locking channel of the louver gives a louver a yellow appearance. To change the color of the louvering system, the colored sheet carried by each of the louvers in the system could merely be replaced with a louver of the desired new color. However, such an approach would require a large inventory of differently colored sheets to provide a wide variety of differently colored systems. It has been found that by constructing the sheets of a transparent or translucent material and superimposing differently colored sheets upon one another, different colors as well as variations of different colors can be obtained. As the possible color combinations of a louver and consequently of a covering system increases as the square of the number of differently colored sheets, a great variety of colors can be developed through a small number of different sheets. By merely maintaining a supply of transparent sheets in 20 different colors, a combination of 400 colors can be obtained. It should also be noted that transparent sheets which are cloudy or translucent could also be employed. Returning to the above example, while the color yellow is obtained through the use of a transparent sheet 24, if a second sheet 26 were disposed over the yellow sheet 24, a third color would appear. If sheet 26 were red, the louver would then appear to be colored orange.

In the preferred embodiment of the invention, the louver is opaque and preferably colored white to avoid alteration of the colors in the transparent or translucent sheets. However, if desired, differently colored louvers could be employed to obtain varying color effects. It should also be noted that a striped effect could be obtained if desired by selective positioning of portions of a differently colored translucent sheet either under or over the first sheet 24. In this manner, a great variety of colors, shades of colors and patterns can be obtained to coordinate a louvered window or door covering with a surrounding decor without the need for a correspondingly large supply of colored covering sheets.

Various changes and modifications may be made in carrying out the present invention without departing from the spirit and scope thereof. Insofar as these changes and modifications are within the purview of the appended claims, they are to be considered as part of the invention.

I claim:

1. A louver for a color variable louvered covering system comprising an elongate panel forming the body of said louver, a flange along each elongate edge of said panel, said flanges extending inwardly toward one another on a first side of said panel, a first transparent sheet of a first color disposed over said elongate panel between said flanges, a second transparent sheet of a second color disposed over said first sheet between said flanges, the colors of said transparent sheets being dissimilar to the color of said panel so that the several colors combined with each other to define a panel of a third color, and mounting means for fixing said sheets to said panel.

2. The combination of claim 1 wherein one or more of said transparent sheets are translucent.

3. A color variable louvered covering system comprising a louver support system, a plurality of louvers, and means for attaching said louvers to said support system, each of said louvers defining an elongate panel having a substantially flat support surface on one side thereof and a locking channel integrally formed therewith and extending along each elongate edge of said support surface on said one side of said panel, a first transparent sheet of a first color disposed over said support surface and a second transparent sheet of a second color disposed over said first sheet to define a third color, each of said first and second sheets being single layered and having opposite side edges received in said locking channels, and mounting means for fixing said sheets to said panels, such that upon removing said sheets from said mounting means, said first and second transparent sheets are removable from said locking channels while maintaining said panels intact in said system to permit one or more sheets of other colors to be applied in the locking channels over said support surface.

4. The combination of claim 3 wherein one or more of said transparent sheets are translucent.

5. A color variable louvered covering system comprising a verticle louver support system, elongate louvers, each said elongate louver including means adjacent one end thereof for attachment to said verticle louver support system, such that said elongate louver depends vertically therefrom, an elongate panel forming the body of said elongate louver, a flange along each elongate edge of said panel, said flanges extending inwardly toward one another on a first side of said panel, a first elongate transparent sheet of a first color arranged on said elongate panel between said flanges, a second elongate transparent sheet of a second color disposed over said first sheet between said flanges, the colors of said transparent sheets being dissimilar to the color of said elongate panel so that the several colors combined with each other to define a panel of a third color, and mounting means for fixing said sheets at one spot to said panel near said attachment means.

6. The combination of claim 5 wherein one or more of said transparent sheets are translucent.

7. In a louver covering system for windows or the like including a louver support system and plurality of louvers attached to said support system and each including an elongated panel defining a substantially flat support surface; the method of changing the color image of at least one panel to any one of a plurality of colors as desired without requiring removal and replacement of said panel relative to the system, the method comprising the steps of: providing a supply of two or more transparent colored sheets dimensioned similarly to said panel with each sheet being colored differently from the other and the panel, and selecting two of said sheets in accordance with a desired color image to be imparted to one side of said panel, and while maintaining said panel in tact in said system detachably assembling said sheets in predetermined superimposed relationship to each other as well as said panel so that the several colors combine with each other to impart said desired color image to one side of said panel.

* * * * *